United States Patent [19]

Otake

[11] 4,342,173

[45] Aug. 3, 1982

[54] TOY MEDICAL OFFICE

[75] Inventor: Michiko Otake, Ichikawashi, Japan

[73] Assignee: Takara Co., Ltd., Tokyo, Japan

[21] Appl. No.: 220,567

[22] Filed: Dec. 29, 1980

[30] Foreign Application Priority Data

Dec. 28, 1979 [JP] Japan ..... 54/184076[U]

[51] Int. Cl.[3] ..... A63H 33/00

[52] U.S. Cl. ..... 46/1 R; 46/12; 46/239; 40/449

[58] Field of Search ..... 46/1 R, 11, 13, 12, 46/236, 239, 238; 40/449, 447, 530, 531, 46

[56] References Cited

U.S. PATENT DOCUMENTS 2,872,753 2/1959 Fenton ..... 46/12

3,426,453 2/1969 Dingwall et al. ..... 46/239 X 4,030,235 6/1977 Terzian et al. ..... 46/11

4,194,318 3/1980 Watanabe ..... 46/1 R X

*Primary Examiner*—Gene Mancene

*Assistant Examiner*—Mickey Yu

*Attorney, Agent, or Firm*—Jackson, Jones & Price

[57] ABSTRACT

A simulated portable doctor's office play set is provided with a diagnostic capability of prescribing specific medication for specific ailments. The diagnostic instrument including a magnet therein is capable of not only contacting the patient, but also a display panel to make visible a particular remedy. The play set further has a capacity of dispensing a color-coded medication container that corresponds to the remedy shown on the display panel.

21 Claims, 4 Drawing Figures

TOY MEDICAL OFFICE

BACKGROUND OF THE INVENTION

1. Field of the Invention

The present invention is directed to a children's play action set, and more particularly, to a simulated doctor's office for diagnosis and treatment of make-believe ailments.

2. Description of the Prior Art

Numerous forms of children's play sets have been provided in the prior art. For example, simulated hair salons, kitchens, bathrooms, and bedrooms have been provided for children to play with. Basically, these play sets have focused the children's attention on one room or commercial establishment as opposed to the conventional doll house having a multiple number of rooms. Frequently, these children's toy sets are designed for a compacted storage mode while opening to an expanding operative mode for toy play. Usually, dolls and various accessories are complementary to the structural configurations of these toy sets.

Although toy play sets of the above-mentioned type have been known in the prior art, there is a continued demand to provide novel and unique play action configurations to retain the interest and attention of the child, particularly younger children with a limited span of attention. Accordingly, there is still a demand in the prior art to provide new and improved toy action sets for the amusement of children.

SUMMARY OF THE INVENTION

The present invention provides a simulated portable doctor's office play set. The play set structure includes a central wall supporting relatively movable side walls for a play mode, or can be moved inward for storage and portability. The central wall supports a display panel having a plurality of semitransparent apertures. Indicia or information indicative of a particular ailment is associated with each aperture. Located behind a semi-transparent panel, positioned in the aperture, are magnitizable display members that are movably mounted to appear through the apertures. The display members are mounted so that gravity positions them away from the aperture and the indicia on the display member is not visible. A simulated diagnostic instrument which includes a magnet is capable of being applied in a play mode to another child or to a doll, and then subsequently applied to the display panel adjacent the indicia that is indicative of the particular ailment. Positioning of the magnet on the exterior indicia of the display panel permits the magnetic field to activate the display member forward to a position adjacent the semi-transparent aperture. The indicia indicative of a remedy for the particular ailment then becomes visible. A member for dispensing simulated medication is provided with appropriate color coding indicia to indicate the particular diagnosed medication that is applicable for the ailment.

The features of the present invention which are believed to be novel are set forth in particularity in the appended claims. The present invention, both as to its organization and manner of operation, together with further objects and advantages thereof, may best be understood by reference to the following description, taken in conjunction with the accompanying drawings.

DESCRIPTION OF THE PREFERRED EMBODIMENT

The followisng specification taken in conjunction with the drawings sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Figure 1:
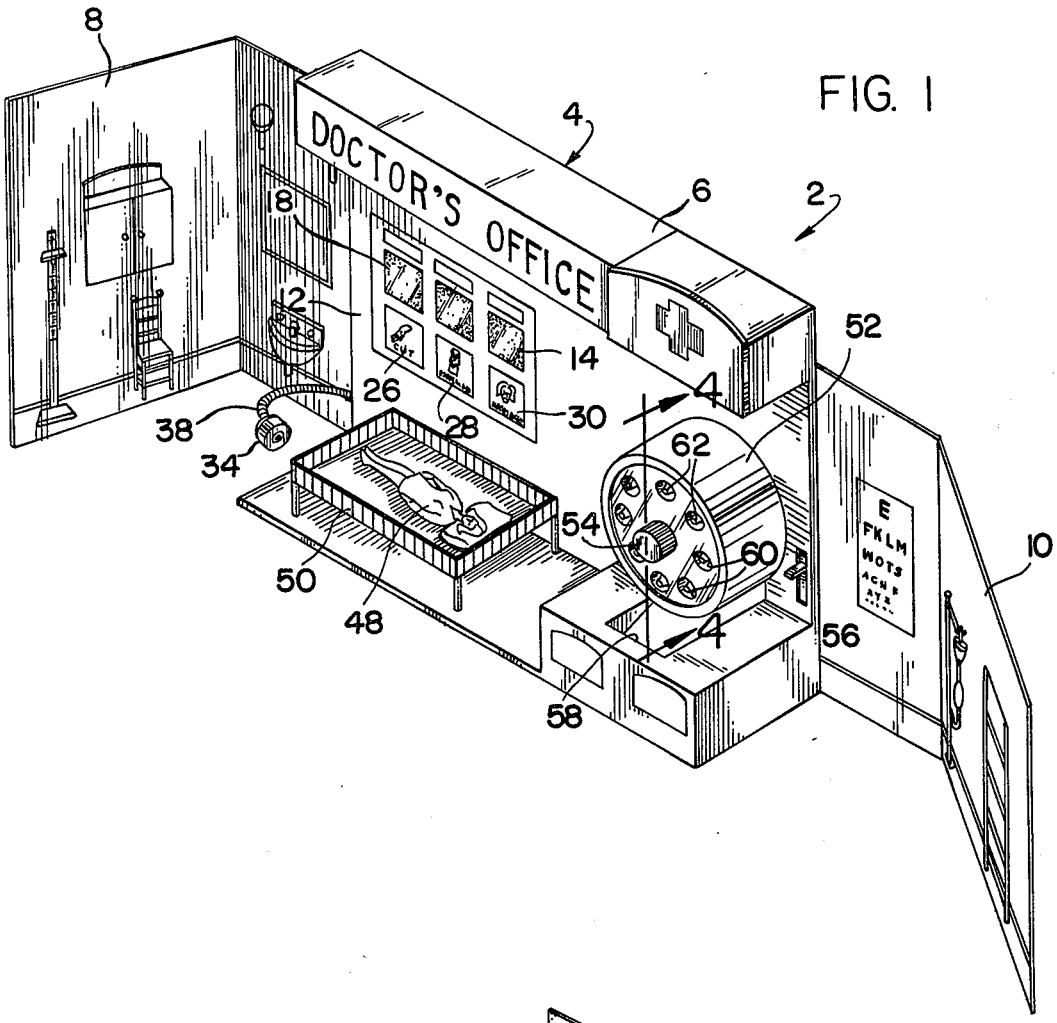
FIG. 1 is a perspective view of a schematic embodiment of the present invention.

Referring to FIG. 1, a perspective view of a simulated portable doctor's office play set 2 is disclosed. The play set is designed to create a three-dimensional simulation of a doctor's office in a play mode of operation, and also to be capable of being folded into a compact storage and portability mode. To accomplish these purposes, the housing member 4 comprises a central wall 6 and a pair of side walls 8 and 10 that can be movably mounted relative to the central wall 6. Preferably, the housing member is formed from plastic or cardboard covered with thin sheets of plastic.

Mounted on the central wall 6 is a display panel member 12 having a plurality of apertures 14, 16 and 18. Each aperture or discrete display areas has a semi-transparent covering or plate 20 that is capable of providing a diffusing effect and obscuring a person's view of any images placed at a distance from the back surface of the plate. The display panel member 12 has positioned beneath each aperture a separate indicia indicative of a particular ailment. Thus, the indicia panel 26 refers to a cut, while panel 28 refers to a stomachache, and panel 30 refers to a headache. Appropriate figurines or simulated pictures of dolls exhibiting the particular ailment can also be positioned on the appropriate panels.

Figure 2:
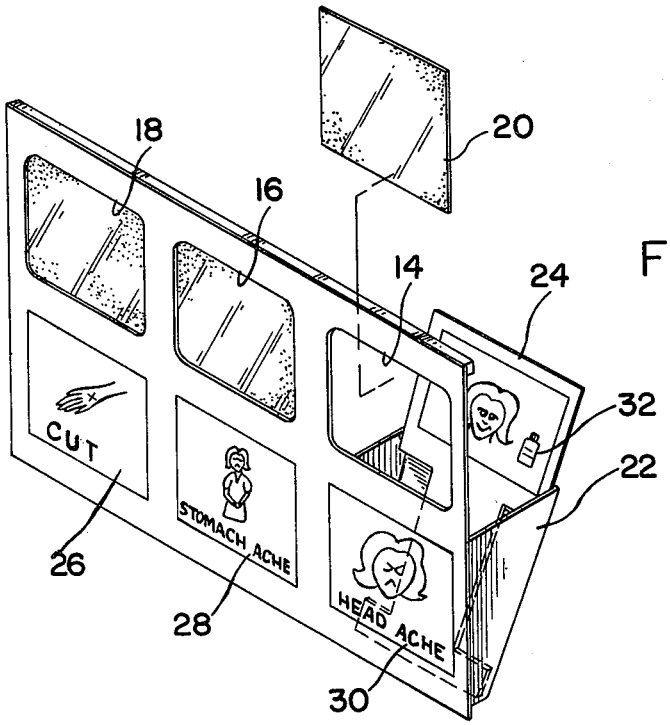
FIG. 2 is a perspective view of the display panel.
Figure 3:
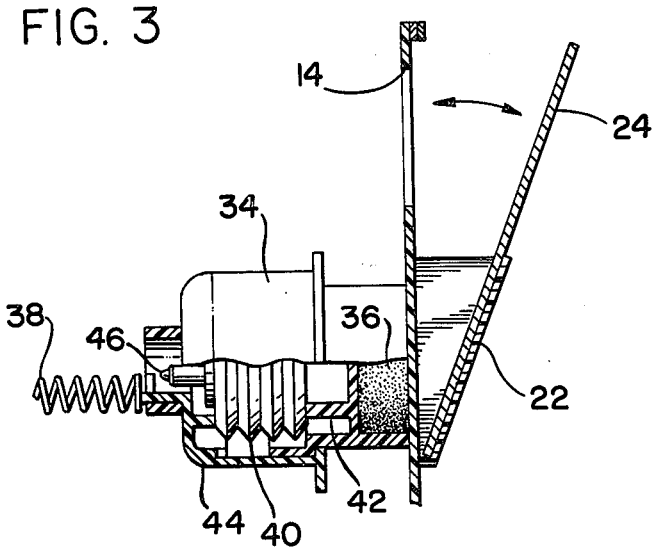
FIG. 3 is a partial cross-sectional view of the display panel and diagnostic instrument.
Figure 4:
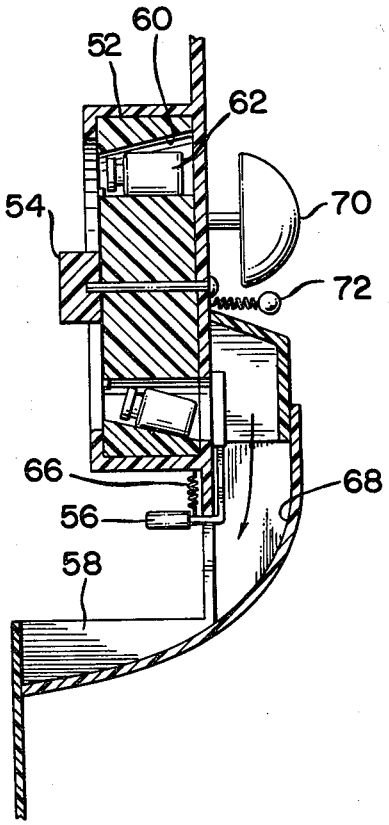
FIG. 4 is a cross-sectional schematic view taken along the lines 4—4 of FIG. 1.

Referring to FIGS. 2 and 3, a tray member 22 is mounted behind each of the apertures and supports a separate display member 24. Preferably, the display member is formed from a magnetizable material such as a thin sheet of iron or a combination plastic-iron laminate. The upper portion of the display member 24 carries appropriate indicia indicative of a remedy for a particular ailment.

The display members can also provide both written and figure indicia indicting the particular remedy to an ailment associated with the lower indicia panel on the display panel 12. Accordingly, the display member carries a picture of a color-coded medication container such as 32.

As can be seen specifically in FIGS. 1 and 3, a simulated diagnostic instrument 34 includes a magnetic member 36 which can be positioned adjacent an indicia panel portion such as 30 to result in the upward movement of the display member 24, so that its indicia bearing surface is immediately adjacent the rear side of the semi-transparent plate 20. The indicia then becomes visible and intelligible to the child user. The child can then identify the particular remedy for the ailment such as the picture of a color-coded medication container 32, e.g., a bottle of pills. The diagnostic instrument 34 is resiliently connected to the housing member by a coiled resilient plastic cable 38. The diagnostic member itself incorporates a flexible plastic bellows 40 that bears against a captured piston member 42 that supports the magnet 36. Both the bellows 40 and the piston member 42 are mounted in a cylindrical housing member 44. The bellows 40 also has a restricted orifice 46 of a conventional design for producing a sound upon contraction of the bellows 40 by rearward movement of the piston member 42.

The child, in performing a diagnostic operation as he simulates the activities of a real-life doctor, can apply the diagnostic instrument 34 in a play action mode. Thus, the diagnostic instrument 34 can be applied against a doll 48 in a supine position on a medical table 50.

Mounted on the central wall 6 is a multi-cavity cylindrical member 52 which provides means for dispensing simulated medication such as pill containers 62. These pill containers 62 are appropriately color-coded to match the pictures of medication containers, e.g., container 32, that are displayed on the display member 24. Thus, when a child positions the magnetic diagnostic instrument 34 to render visible the remedy for the particular ailment, the child is thereby informed of the particular simulated medication that is necessary to correct the doll's ailment. A knob member 54 can then be manipulated to revolve the appropriate color-coded medication container 62 to the lower-most position. A lever 56 is then activated in a downward movement to permit the release of the medication from the cylindrical multi-cavity storage container. Medication then appears in the lower dispensing tray 58 for access by the child. Each of the cavities 60 in the cylindrical member 52 are adapted to receive individual medication containers 62. The individual cavities have a conical configuration with a sufficient slope to permit gravity to urge the particular medication container 62 to the rear of its compartment when in the lower or six o'clock position. The lever 56 is attached to a movable panel or gate 64 which forms the back wall of the cavities when they are in the lowest position. A spring 66 biases the lever 56 and the gate 64 to an upward closed position. A chute member 68 conveys the medication container 62 to the dispensing tray 58. If desired, a bell 70 can be struck by a resilient striker 72 to provide an optional sound generation, either upon the rotation of the knob 54 or upon the actuation of the lever 56. The specific camming structures for actuating the resilient striker 72 are not disclosed but are well known in the prior art.

Additional accessory furniture and instruments of a medical nature can accompany the play set 2. Additionally, the side walls and central wall can carry appropriate images of medical equipment, chairs, scales, plasma, eye charts, etc., to create the maximum realistic impression on the child.

The play set 2 can be maintained in a compact storage configuration with the side walls 8 and 10 collapsed to form a rectangular configuation with the central wall 6. Appropriate fastening devices such as Velcro tabs, or hooks, can be used to maintain the configuration. Additionally, a handle can be positioned on the top of the housing member to assist in the portability of the play set 2. The child, when he wishes to play with the play set 2, positions the side walls 8 amd 10 to simulate a docctor's ofice. The child can position a doll 48 onto the medical table 50 and can utilize the diagnostic instrument 34 by pressing it against the doll. When appropriately pressed, the bellows 40 will create a noise. It should be recognized that the child could likewise diagnose himself or another playmate in a simulated medical analysis. The child, with the application of imagination as to the particular ailment that is being suffered by his "patient", then places the diagnostic instrument 34 adjacent his selected ailment such as a headache 30. The magnetic member 36 is than at a predetermined distance from the magnetic display member 24 to overcome the force of gravity by its magnetic force and to pivot the display member 24 adjacent the rear surface of the semi-transparent plate 20. When this occurs, the child can then determine the appropriate medication such as a red medication container 32. The child then rotates the multi-cavity storage member 52 by means of the knob 54 until a red medication container 62 is positioned at a six o'clock release position. Activation of the lever 56 then releases the medication container 62 so that it falls into the dispensing lower tray 58 with the possibility of an additional ringing sound when a striker 72 strikes the bell 70.

The child thus enjoys a highly innovative and satisfying play environment wherein he defines a specific medication that is applicable to a particular ailment. Thus, an instructional feature is further taught to the child in differentiation between various forms of medication for various ailments.

While the preferred embodiment of the present invention has been disclosed, it is readily apparent that variations are possible to an artisan skilled in this art, once given the generic principles of the present invention. Accordingly, the scope of the present invention should be determined solely from the following claims, wherein I claim:

1. A play toy set simulating a medical ofice comprising:

a housing member;

a display panel having a plurality of discrete display areas mounted on the housing member;

indicia indicative of a particular ailment positioned adjacent each discrete display area;

a plurality of information members positioned behind the display panel and mounted for selective display to the user, each information member providing an indication of a remedy for a particular ailment, and a simulated diagnostic instrument capable of application to a child or a doll figure and activating the display of an information member on the display panel.

2. The invention of claim 1 further including means for dispensing simulated medication for treating a particular ailment.

3. The invention of claim 1 wherein the information members include a magnetizable portion and the diagnostic instrument includes a magnet, the magnetic force field of the magnet positioning an information member on the display panel.

4. The invention of claim 2 wherein the means for dispensing simulated medication includes a multi-cavity member and a plurality of simulated medication containers, the multi-cavity member relatively movable to release a specific simulated medication container for treating a pre-selected particular ailment.

5. The invention of claim 4 further including a lever member which control the release of the medication containers from the multi-cavity member.

6. The invention of claim 5 wherein the multi-cavity member is cylindrical and is rotatably mounted on the housing member.

7. The invention of claim 1 wherein the diagnostic instrument includes a sound generating device.

8. The invention of claim 7 wherein the diagnostic instrument is resiliently connected to the housing member.

9. The invention of claim 2 wherein the housing member includes a central wall and a pair of side walls that are movably connected to the housing member in order to form a compact portable configuration.

10. A simulated portable doctor's office play set for children comprising:

a housing member having a central wall and a pair of side walls appropriately covered with indicia indicative of a doctor's office, the side walls movably connected to the central wall to move outward for a play mode or to move inward for storage and portability;

a display panel mounted on the central wall having a plurality of semi-transparent apertures, indicia indicative of a particular ailment positioned adjacent each aperture;

magnetizable display members movably mounted behind the apertures of the display panel, each display member having indicia indicative of a remedy for a particular ailment, and a simulated diagnostic instrument including a magnet for activating a particular display member for display through a semi-transparent aperture.

11. The invention of claim 10 further including means for dispensing simulated medication for treating a particular ailment.

12. The invention of claim 11 wherein the means for dispensing simulated medication for treating a particular ailment includes a multi-cavity cylindrical member rotatably mounted on the housing member, a simulated medication container mounted in each cavity, means for rotating the cylindrical member to position a particular medication container and means for releasing the medication container from the cylindrical member.

13. The invention of claim 12 wherein the diagnostic instrument is resiliently connected to the housing member.

14. The invention of claim 13 wherein the diagnostic instrument includes a bellows member having a restricted orifice to produce a sound upon contraction.

15. A play toy set simulating a medical office comprising:

a housing member;

a display panel mounted on the housing member;

a plurality of information members positioned behind the display panel and mounted for selective display to the user, each information member providing an indication of a remedy for a particular ailment;

a simulated diagnostic instrument, capable of application to a child or a doll figure, for activating the display of an information member on the display panel, and means for dispensing simulated medication for treating a particular ailment including a multi-cavity member and a plurality of simulated medication containers, the multi-cavity member relatively movable to release a specific simulated medication container for treating a pre-selected particular ailment.

16. The invention of claim 15 further including a lever member which controls the release of the medication containers from the multi-cavity member.

17. The invention of claim 15 wherein the multi-cavity member is cylindrical and is rotatably mounted on the housing member.

18. The invention of claim 15 wherein the diagnostic instrument includes a sound generating device.

19. The invention of claim 15 wherein the diagnostic instrument is resiliently connected to the housing member.

20. The invention of claim 15 wherin the housing member includes a central wall and a pair of side walls that are movably connected to the housing member in order to form a compact portable configuration.

21. The invention of claim 15 wherein the information members include a magnetizable portion and the diagnostic instrument includes a magnet, the magnetic force field of the magnet positioning an information member on the display panel.

* * * * *

UNITED STATES PATENT AND TRADEMARK OFFICE

CERTIFICATE OF CORRECTION

PATENT NO. : 4,342,173

DATED : August 3, 1982

INVENTOR(S) : Michiko Otake

It is certified that error appears in the above-identified patent and that said Letters Patent are hereby corrected as shown below:

Column 2, line 35, after "apertures" insert

--or discrete display areas--.

Column 2, line 36, after "aperture" delete

"or discrete display areas".

Column 4, line 39, delete "ofice" and insert

--office--.

Column 5, line 7, delete "claim 1" and insert

--claim 3--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*